United States Patent [19]

Kikuchi et al.

[11] 4,086,729

[45] May 2, 1978

[54] FEED AMOUNT SETTING DEVICE FOR A MACHINE TOOL

[75] Inventors: Makoto Kikuchi, Kariya; Ikuo Otsu, Toyota, both of Japan

[73] Assignee: Toyoda Koki Kabushiki Kaisha, Japan

[21] Appl. No.: 795,520

[22] Filed: May 10, 1977

[30] Foreign Application Priority Data

May 27, 1976 Japan ..... 51-67803[U]

[51] Int. Cl.[2] ..... B24B 49/00

[52] U.S. Cl. ..... 51/165.8

[58] Field of Search ..... 51/165.8, 165.81, 165.85, 51/165 R

[56] References Cited

U.S. PATENT DOCUMENTS

| | | | |
|---|---|---|---|
| 2,709,877 | 6/1955 | Dall | 51/165.81 |
| 3,622,287 | 11/1971 | Kurimoto | 51/165.8 |
| 3,822,512 | 7/1974 | Mercer | 51/165.81 |

*Primary Examiner*—Harold D. Whitehead

*Attorney, Agent, or Firm*—Oblon, Fisher, Spivak, McClelland & Maier

[57] ABSTRACT

A feed amount setting device for a machine tool is provided wherein an axially slidable follower rod is urged to contact a plate cam rotated by a feed device of the machine tool and is formed with an operating face for pivoting a lever arm, such that movement thereof is transmitted to a switch actuation plunger in a predetermined magnification ratio. A lever support carrying the lever arm is adjustable in a direction parallel with the follower rod, and the plunger is formed with a flat face extending in parallel relation with the adjusting direction of the lever support for engagement with the lever arm, so that the feed amount of the feed device, depending on a signal from a switch element, is variable without adjusting the mounting position of the switch element.

7 Claims, 6 Drawing Figures

13
14
21
22
23
24
25
26
27
30
31
32
33
35
36
37
38
39
40
41
42
43
44
45
46
47
49
50
51
53
55
56
58
64
71
72
73
74
83
84
90
91
92
93
94
95
θ
IV
VI

FEED AMOUNT SETTING DEVICE FOR A MACHINE TOOL

BACKGROUND OF THE INVENTION

1. Field of the Invention

This invention relates generally to machine tools, and more particularly to a feed amount setting device for a machine tool for setting the feed amount of a tool or workpiece carrier.

2. Description of the Prior Art

In a known grinding machine capable of plunge grinding, a dead stop mechanism is provided to restrict the grinding feed advanced end of a wheel slide. When alteration of the automatic grinding feed amount is needed, the angular position of a feed amount setting ring, which has a movable stop engageable with a stationary dead stop, is adjusted relative to a hand wheel and is connected thereto at the adjusted position.

However, the alteration of the feed amount requires an operator to disconnect the setting ring from the hand wheel, to adjust the relative angular position therebetween, and to again connect the setting ring to the hand wheel, and therefore is a somewhat troublesome activity.

SUMMARY OF THE INVENTION

Accordingly, it is a primary object of the present invention to provide an improved feed amount setting device for a machine tool which is easy in handling and exact and reliable in operation.

Another object of the present invention is to provide an improved device of the character set forth in which setting of the feed amount is achieved by only one rotational manipulation of an adjusting member.

A further object of the present invention is to provide an improved device of the character set forth in which alteration of the feed amount is performed, without displacing a switch element itself, by moving a lever mechanism whose motion transmission ratio is maintained constant irrespective of the mechanism being moved.

A still further object of the present invention is to provide an improved device of the character set forth which is capable of setting not only a whole feed amount, but also a fine feed amount therewithin.

Briefly, according to the present invention, there is provided a feed amount setting device, which comprises a cam member supported to be movable along with a feed device which relatively feeds tool and workpiece carriers, an axially slidable follower rod urged to contact the cam member and formed with an operating face, a lever support slidably guided for movement in a direction parallel with the axis of the follower rod, adjusting means for sliding the lever support in that direction, switch actuation means supported to be movable in a direction substantially perpendicular to the axis of the follower rod, and a lever arm pivotably carried on the lever support for moving the switch actuation means in a predetermined magnification ratio, when engaged with the operating face.

The device further comprises contact face means extending parallel to the sliding direction of the lever support for maintaining contact engagement between the lever arm and the actuation means within an adjustable range of the lever support and a switch element stationarily disposed for controlling the feed device when actuated by the actuation means, whereby the feed amount of the tool or workpiece carrier is adjusted by manipulating the adjusting means without displacing the switch element.

BRIEF DESCRIPTION OF THE DRAWINGS

Various other objects, features and attendant advantages of the present invention will be readily appreciated as the same becomes better understood by reference to the following detailed description of a preferred embodiment, when considered in connection with the accompanying drawings, in which.

DETAILED DESCRIPTION OF THE PREFERRED EMBODIMENT

Figure 1:
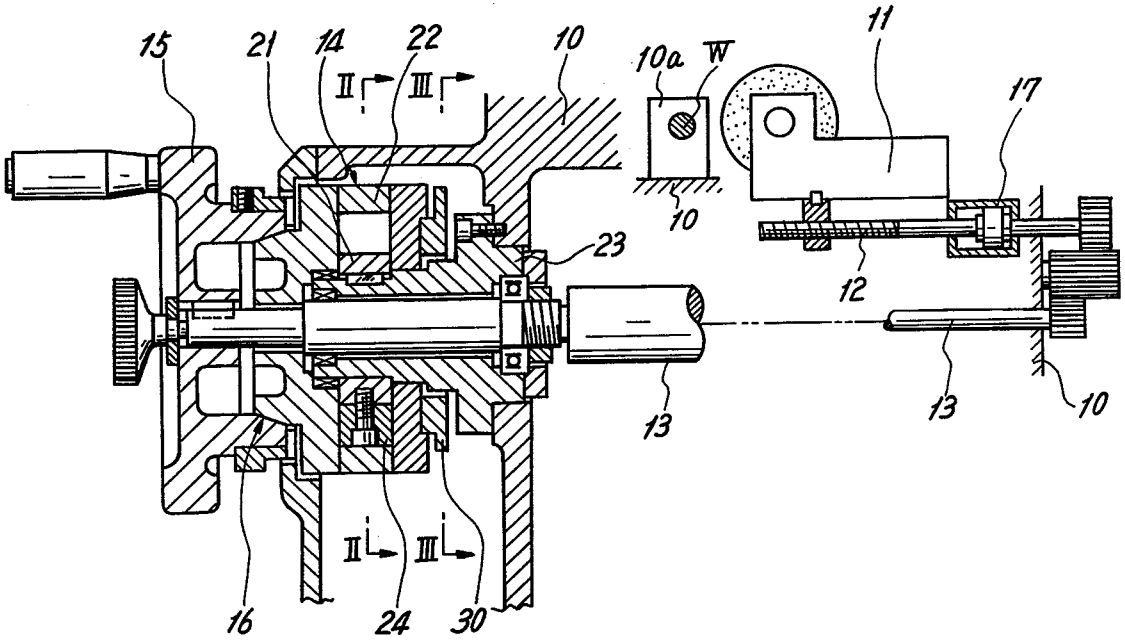
FIG. 1 is a longitudinal sectional view of a wheel head feed device with a feed amount setting device according to the present invention.

Referring now to the drawings, wherein like reference numerals designate like or corresponding parts throughout the several views, and particularly to FIG. 1 thereof, the reference numeral 10 denotes a bed of a grinding machine, on which a wheel carrier or head 11 is slidably mounted to be forwardly and backwardly moved by a feed screw 12 to and from a carrier **10*a* for a workpiece W. This feed screw 12 is drivingly connected through a gear train, not numbered, with a drive shaft 13, which is in turn connected with a drive device 14 so as to be rotated thereby. A hand wheel 15 is keyed on one end of the drive shaft 13 and is connectable integrally with the drive device 14 by means of a clutch 16. The reference numeral 17** denotes a rapid feed actuator.

Figures 2, 3:
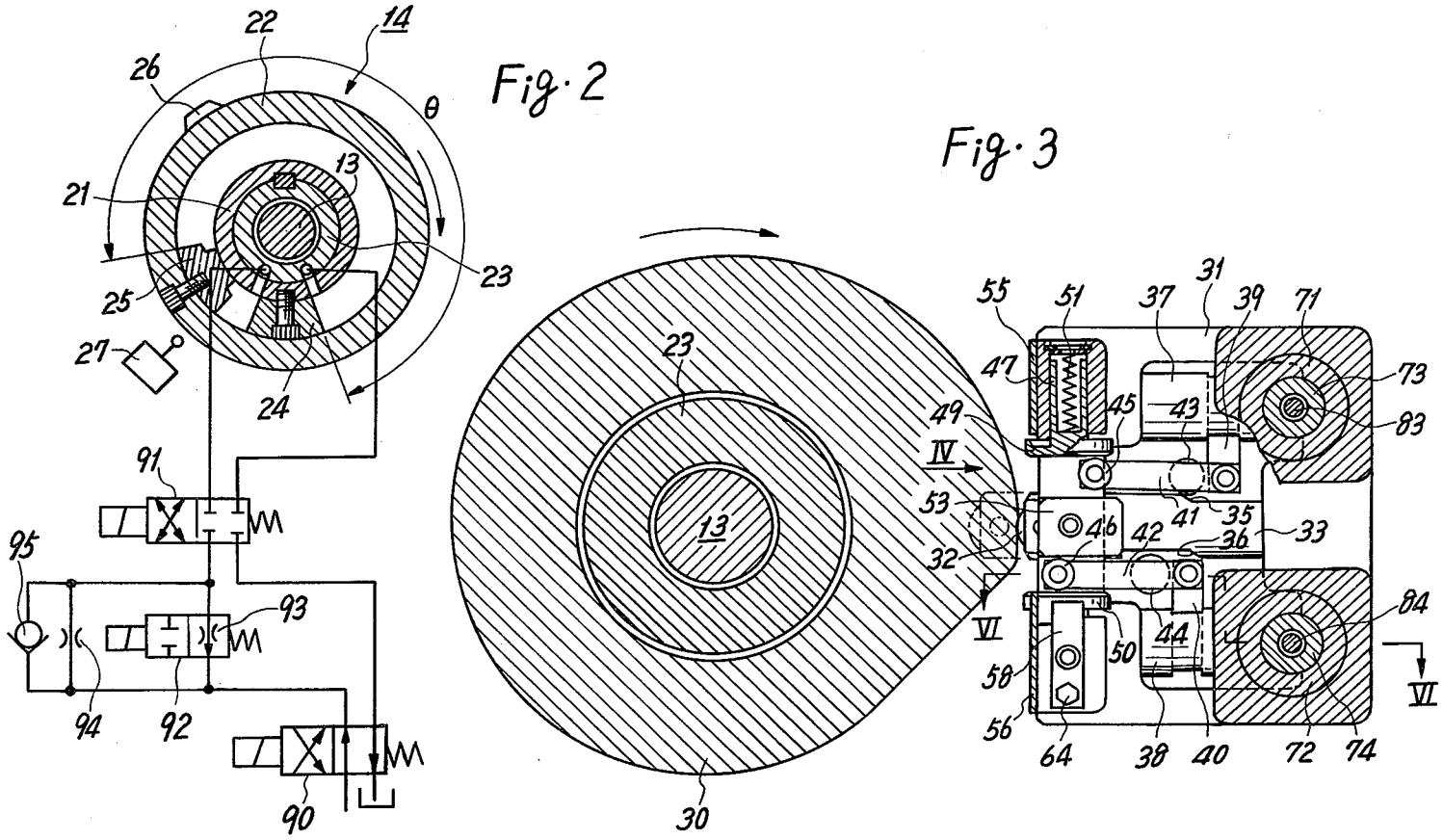
FIG. 2 is a sectional view taken along the line II—II of FIG. 1.
FIG. 3 is a sectional view taken along the line III—III of FIG. 1.

The drive device 14 is constructed by a rotational actuator composed of a cylinder housing 22 and an internal cylinder 21 which is contained in the housing 22 to be rotatable relative thereto. The internal cylinder 21 is keyed on a support sleeve 23 fixed on the bed 10, while the cylinder housing 22 is rotatably supported on the support sleeve 23. As best shown in FIG. 2, the internal cylinder 21 has a dead stop 24 fixed on the outer periphery thereof, and the cylinder housing 22 has fixed on its internal surface a movable wing 25, which is in an abuttable relation with the dead stop 24. Also provided on the cylinder housing 22 is a dog 26, by which a limit switch 27 is disposed to be activated for confirming the advanced feed end of the wheel head 11. Behind and to the cylinder housing 22, there is secured a plate cam 30 with a circumferential cam way, in opposition to which a main body 31 of a feed amount setting device is fixedly mounted on the bed 10.

Figure 5:
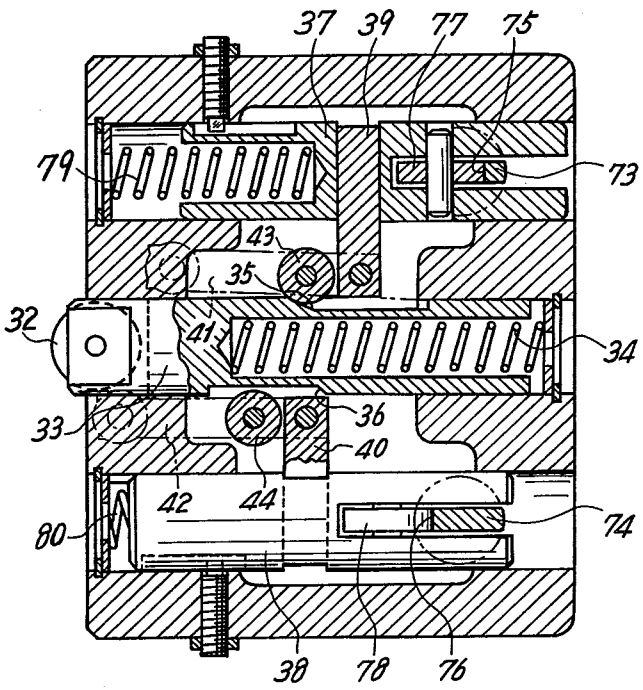
FIG. 5 is a sectional view taken along the line V—V of FIG. 4.
Figure 4:
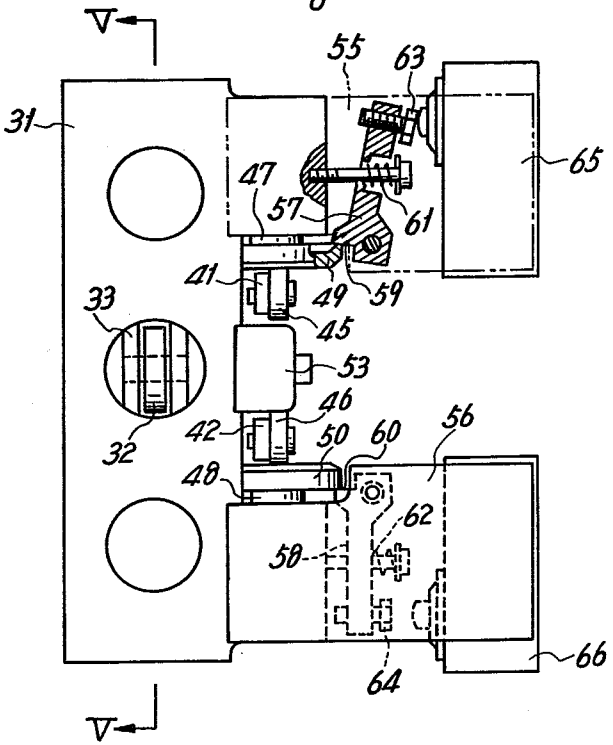
FIG. 4 is a front view of the setting device, partly in section, viewed from the direction of the arrow IV in FIG. 3.

As shown in detail in FIGS. 3 to 5, the main body 31 has slidably received therein, for axial movement, a follower rod 33, on which a follower roller 32 is rotatably carried for contact with the circumferential cam way of the plate cam 30. The follower rod 33 is urged by means of a spring 54 to be always in contact, at the follower roller 32, with the plate cam 30. On the outer periphery of the follower rod 33, there are formed two axially extending cutouts, which are respectively provided at the front and rear ends thereof with operating cam faces 35 and 36, in the form of acclivity and declivity. Lever support rods 37 and 38 are contained in the main body 31 to be slidable in a direction parallel with the axis of the follower rod 33 and are arranged to be adjustably positioned by adjusting mechanisms, which will be referred to later, respectively. Support arms 39 and 40, secured to the lever support rods 37 and 38, have their one ends extended near the follower rod 33, and lever arms 41 and 42 are pivotably hinged at the one ends, respectively. On the lever arms 41 and 42, first contact rollers 43 and 44, respectively engageable with the operating cam faces 35 and 36, are carried at such positions as to be remote by a distance or length l1 from the pivot points, from which second contact rollers 45 and 46 are also carried at such positions as to be remote by a length l2, respectively. This length l2 is taken to be enough longer than the length l1, so that minute displacements of the first contact rollers 43 and 44, given by the operating cam faces 35 and 36, effect on the second contact rollers 45 and 46 l2/l1 times as much displacement as the first contact rollers 43 and 44 respectively do.

Within the main body 31, switch actuation plungers 47 and 48 are contained to be slidable in a direction perpendicular to the lever support rods 37 and 38 and, at the outer ends thereof, are formed with face plate or flanges 49 and 50, extending at least in a direction parallel with the sliding direction of the lever support rods 37 and 38, respectively. The actuation plungers 47 and 48 are spring-biased, as typically shown at 51, in such directions as to contact the flanges 49 and 50 with the second contact rollers 45 and 46 and, with this spring bias action, the lever arms 41 and 42 may be held in contacting engagement with a rest block 53, secured to the main body 31, through their second contact follers 45 and 46, respectively. It is herein noted that the diameters D of the flanges 49 and 50 are respectively designed to be at least larger than the adjustable strokes or ranges of the lever support rods 37 and 38, in order that the contact relationships between the flanges 49 and 50 and the second contact rollers 45 and 46 are respectively maintained throughout the adjustable ranges of the lever support rods 37 and 38.

To the main body 31, there are further secured support plates 55 and 56, on which switch actuation links 57 and 58 are respectively pivotably hinged. These links 57 and 58 are formed with engagement portions 59 and 60, which are maintained in engagement with the flanges 49 and 50 of the actuation plungers 47 and 48 in such a way as to offer a turning moment to the actuation links 57 and 58, by the use of springs 61 and 62, respectively. Bolts or tappets 63 and 64 are adjustably threaded at one end of each of the actuation links 57 and 58, and first and second limit switches 65 and 66, actuatable by the tappets 63 and 64, are stationarily disposed upon the support plates 55 and 56, respectively. The distance between each tappet 63 and 64 and the pivot points of the respective one of the links 57 and 58 is made several times as long as the distance between the pivot point and the respective one of the engagement portions 59 and 60, so that displacements of the flanges 49 and 50 are transmitted respectively to the tappets 63 and 64 with some magnification.

Figure 6:
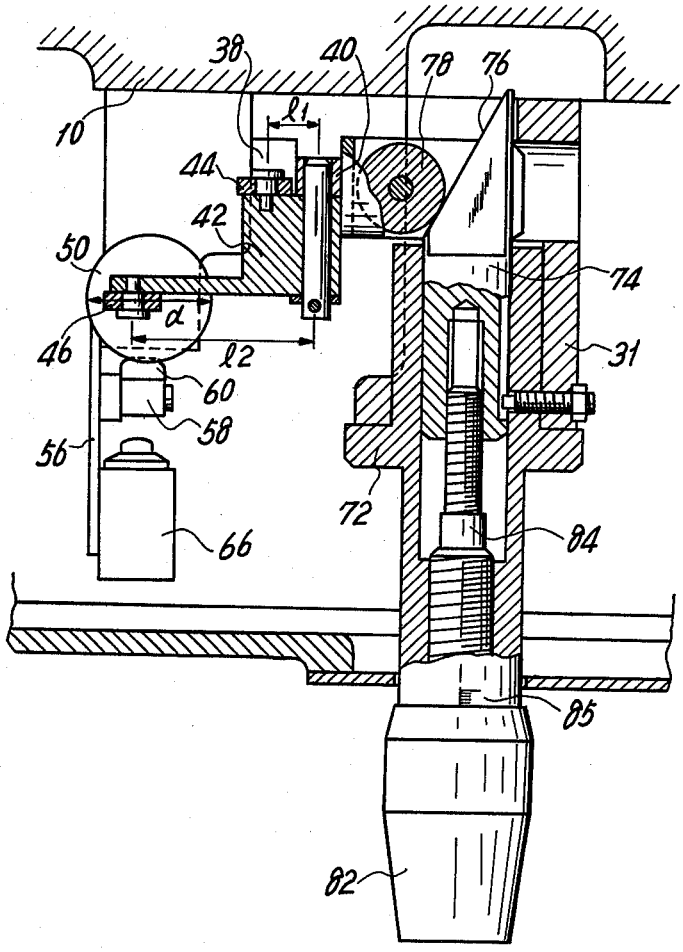
FIG. 6 is a sectional view taken along the line VI—VI of FIG. 3.

Position adjusting mechanisms for the lever support rods 37 and 38 will hereinafter be described with reference to FIGS. 3, 5 and 6. Fixed on the main body 31 are support sleeves 71 and 72, into which cross shafts 73 and 74 are respectively inserted to be slidable in a direction perpendicular to the lever support rods 37 and 38. The cross shafts 73 and 74 are formed with wedge faces 75 and 76, which third contact rollers 77 and 78, carried on the lever support rods 37 and 38, are urged by means of the springs 79 and 80 to contact, respectively. The cross shafts 73 and 74 are able to be advanced and retracted with the rotational adjustments of adjusting knobs, only one of which, namely knob 82, is shown, through adjusting screws 83 and 84, so that the lever support rods 37 and 38 are adjustably positioned in their axial directions, respectively. The adjusted positions of the lever support rods 37 and 38 can be readable from graduations, as typically indicated at 85, marked at the outer surfaces of the support sleeves 71 and 72.

It is to be understood that the grinding feed amount of the wheel head 11 given by the rotational actuator 14 is arbitrarily adjustable or settable be varying a rotational angle $\theta$ of the movable wing 25 up to contact engagement with the dead stop 24. This setting can be attained with positional adjustment of the lever support rod 37, which results from rotating the adjusting knob, now shown. It is further to be understood that the fine feed amount of the grinding feed amount is also arbitrarily settable with positional adjustment of the lever support rod 38, which results from rotating the other adjustable knob 82. Although this particular embodiment is so constructed as to protrude the adjusting knob 82 beyond the front side of the bed 10, as shown in FIG. 6, in order to provide for easy adjustment of the lever support rods 37 and 38, adjusting mechanisms for the same are not limited to those in the embodiment.

The operation of the device, as mentioned before, will be described hereunder. It is now assumed that the device is in the original condition as shown in all of the FIGURES, wherein the first limit switch 65 has been actuated.

First of all, the wheel head 11 is rapidly advanced by the rapid feed cylinder 17, and then change-over valves 90 and 91 are switched to supply fluid under pressure into the rotational actuator 14, whereby the cylinder housing 22 is rotated in the direction of the arrow. Fluid from the rotational cylinder 14 is exhausted through a first throttle 93 of a change-over valve 92. Thus, the feed screw 12 is rotated through the clutch 16, the hand wheel 15, the drive shaft 13 and the gear train, and the wheel head 11 is advanced at a coarse grinding feed rate regulated by the first throttle 93. With rotation of the cylinder housing 22, the plate cam 30 is also rotated bodily therewith in the direction of the arrow, and the follower rod 33, following the circumferential cam way, is gradually advanced toward the left, as viewed in FIG. 3, due to the provision of the spring 34. Thus, engagement between the operating cam face 35 and the first contact roller 43 is released to pivot the lever arm 41, based upon the spring action given to the actuation plunger 47, and this renders the first limit switch 65 from ON to OFF.

With the operation of the rotational actuator 14, the wheel head 11 is fed a predetermined amount at the coarse grinding feed rate, and when the operating cam face 36 of the follower rod 33, following the plate cam, is engaged with the first contact roller 44 of the lever arm 42, the same is pivoted in a counterclockwise direction, as viewed in FIG. 3, so as to cause the second contact roller 46, with magnified displacement, to depress the actuation plunger 48 against the force of the spring, not shown. Based upon displacement of the actuation plunger 48, the actuation link 58, engaging thereto, is pivoted against the force of the spring 62 in a counterclockwise direction, as viewed in FIG. 4, with the result that the tappet 64 thereof actuates the second limit switch 66. An operational signal from this limit switch 66 effects switching of the change-over valve 92 and, in consequence, fluid from the rotational actuator 14 is exhausted through, at this time, a second throttle 94, whereby the feed rate of the wheel head 11 is switched to a fine grinding one regulated by the second throttle 94. Subsequently, when the wheel head 11 has been finely fed another predetermined amount, the movable wing 25 of the rotational actuator 14 comes into contact with the dead stop 24, stopping the feed movement of the wheel head 11, and this stopping is confirmed by the limit switch 27, as the same is actuated by the dog 26 at the same time.

When the grinding operation of the workpiece W is completed in the foregoing manner, the wheel head 11 is rapidly retracted by the rapid feed cylinder 17, simultaneously with which the changeover valve 90 is switched to the state in FIG. 2, whereby fluid under pressure is supplied into the rotational actuator 14 through a check valve 95 to thereby reversely rotate the cylinder housing 22. The plate cam 30 is reversely rotated along with the cylinder housing 22, during which the follower rod 33 is gradually retracted in opposition to force of the spring 34. When the cylinder housing 22 and the plate cam 30 have been reversed the predetermined angle $\theta$, the operating cam face 35 is engaged with the first contact roller 43, and the lever arm 41 is pivoted in the clockwise direction, as viewed in FIG. 3. With pivotal movement of the lever arm 41, magnified displacement is brought about on the second contact roller 45, which thus depresses the actuation plunger 47 against the spring 51 and, as a result, the first limit switch 65 is actuated by the tappet 63 of the actuation link 57. An operational signal of the limit switch 65 effects switching of the change-over valve 91 to the state in FIG. 2, so that supply and exhaust of fluid under pressure to and from the rotational actuator 14 is interrupted, with the result of stopping the movable wing 25 at such a position as shown in FIG. 2.

In this manner, the follower rod 33 is slidably moved on the traces of the plate cam 30, and with displacement of the lever arms 41 and 42, responding to the operating cam faces 35 and 36 of the follower rod 33, the actuation plungers 47 and 48 are moved in a direction perpendicular to the follower rod 33, so as to actuate the limit switches 65 and 66. Because the flanges 49 and 50 of the actuation plungers 47 and 48 are so extended as to maintain contacting relationships with the second contact rollers 45 and 46, even when the lever arms 41 and 42 are adjusted to any positions within the adjustable ranges, there can be obtained an advantage that the lever ratio l2/l1 of the lever arms 41 and 42 is always maintained constant irrespective of positional adjustments of the lever support rods 37 and 38.

Although the foregoing particular embodiment incorporates the second magnification mechanisms composed of the actuation links 57 and 58, the mechanisms are not essential components for the present invention. It is further to be noted that, where cooperated with a feed mechanism which is incapable of two-step feed (coarse grinding feed, fine grinding feed) unlike the illustrated embodiment, the invented device may be applied only to setting of the whole grinding feed amount and may be omitted with respect to the half mechanism positioned below the follower rod 33, as viewed in FIGS. 3 to 5.

As mentioned previously, according to the present invention, the setting of a feed amount can be achieved in an exact and reliable manner.

Obviously, other modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A feed amount setting device for a machine tool wherein a feed device is provided to relatively feed tool and workpiece carriers, comprising:

a cam member supported to be movable with said feed device;

a follower rod slidably guided for axial movement and urged to contact said cam member, said follower rod being formed with an operating face;

a lever support slidably guided for movement in a direction parallel with the axis of said follower rod;

adjusting means for adjustably postioning said lever support in the sliding direction thereof;

switch actuation means supported for movement in a direction substantially perpendicular to the axis of said follower rod;

a lever arm pivotably carried on said lever support for transmitting movement of said follower rod to said switch actuation means in a predetermined magnification ratio when engaged with said operating face;

contact face means extending in the sliding direction of said lever support for maintaining contacting engagement between said lever arm and said switch actuating means within an adjustable range of said lever support; and a switch element stationarily disposed for controlling said feed device when actuated by said switch actuation means.

2. A feed amount setting device as claimed in claim 1, wherein said switch actuation means comprises an actuation plunger supported to be movable in a direction perpendicular to said follower rod and urged to contact said lever arm, and wherein said contact face means is formed on said actuation plunger.

3. A feed amount setting device as claimed in claim 2, wherein said adjusting means comprises:

a wedge member guided for movement in a direction perpendicular to the sliding direction of said lever support and having a wedge face engaged with said lever support; and adjusting screw means threadedly engaged with said wedge member for moving said wedge member when rotated so as to thereby adjustably position said lever support in a direction parallel to the axis of said follower rod.

4. A feed amount setting device as claimed in claim 3, wherein said switch actuation means further comprises:

an actuation link carried to be pivotable within a plane containing the axis of said actuation plunger and engaged with the same for pivot movement; and a tappet member provided on said actuation link to magnify movement of said actuation plunger and being engageable with said switch element for actuating the same.

5. A feed amount setting device as claimed in claim 4, wherein said lever arm carried on said lever support is pivotable within a plane containing the axis of said follower rod.

6. A feed amount setting device as claimed in claim 5, wherein said cam member is a plate cam having a circumferential cam way and supported to be rotated by said feed device, and wherein said follower rod is slidably supported in a radial direction of said plate cam to contact with said circumferential cam way.

7. A feed amount setting device for a machine tool wherein a feed device is provided to relatively feed tool and workpiece carriers, comprising:

a cam member supported to be movable with said feed device:

a follower rod slidably guided for axial movement and urged to contact said cam member, said follower rod being formed with first and second operating faces;

first and second lever supports respectively slidably guided for movement in a direction parallel with the axis of said follower rod;

first and second adjusting means for respectively adjustably positioning said first and second lever supports in the sliding direction thereof;

first and second switch actuation means respectively supported for movement in a direction substantially perpendicular to the axis of said follower rod;

first and second lever arms respectively carried on said first and second lever supports for transmitting movement of said follower rod to said first and second switch actuation means in a predetermined magnification ratio when engaged respectively with said first and second operating faces;

first and second contact face means extending in the sliding direction of said first and second lever supports for respectively maintaining contacting engagement between said first and second lever arms and said first and second switch actuation means within adjustable ranges of said first and second lever supports; and first and second switch elements stationarily disposed for controlling said feed device so as to set a whole machining feed amount and a fine machining feed amount therewithin when actuated respectively by said first and second switch actuation means.

* * * * *